US007145089B2

(12) United States Patent
Bogdon et al.

(10) Patent No.: US 7,145,089 B2
(45) Date of Patent: Dec. 5, 2006

(54) SELF RETAINING SLIDING BAR INTERLOCK FOR CIRCUIT BREAKER

(75) Inventors: Erik Russell Bogdon, Carnegie, PA (US); Vicki Diane Fodi, Beaver Falls, PA (US); Ronald William Brand, Beaver Falls, PA (US); Lance Gula, Clinton, PA (US); Dominic Patrick Martelli, McKees Rocks, PA (US); James Alan Trax, Oakdale, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/226,631

(22) Filed: Sep. 14, 2005

(65) Prior Publication Data

US 2006/0070861 A1 Apr. 6, 2006

Related U.S. Application Data

(60) Provisional application No. 60/615,124, filed on Oct. 1, 2004.

(51) Int. Cl.
*H01H 9/28* (2006.01)

(52) U.S. Cl. ..... 200/43.16; 200/43.01; 200/50.33

(58) Field of Classification Search ..... 200/43.16
See application file for complete search history.

(56) References Cited

U.S. PATENT DOCUMENTS 4,980,525 A * 12/1990 Kakisako ..... 200/50.4
5,397,868 A * 3/1995 Smith et al. ..... 200/18
5,790,369 A * 8/1998 Sitler ..... 361/643
6,043,439 A * 3/2000 Crooks et al. ..... 200/50.33

* cited by examiner

*Primary Examiner*—Elvin Enad
*Assistant Examiner*—Lheiren Mae A. Anglo
(74) *Attorney, Agent, or Firm*—Martin J. Moran

(57) ABSTRACT

An interlock mechanism for preventing a first circuit breaker having a first actuating mechanism and a second circuit breaker having a second actuating mechanism from simultaneously being in a closed condition. The interlock mechanism includes a frame, a sliding bar slideably mounted within the frame, and one or more retaining protrusions extending outwardly from one or more inner edges of the frame. The sliding bar is movable between a first position and a second position. In the first position the sliding bar blocks a path of movement of the first actuating mechanism and in the second position the sliding bar blocks a path of movement of the second actuating mechanism. The one or more retaining protrusions frictionally engage the sliding bar when the sliding bar is in the first position and holds it in place, preferably with a frictional force sufficient to resist the force of gravity and/or vibrations.

10 Claims, 3 Drawing Sheets

SELF RETAINING SLIDING BAR INTERLOCK FOR CIRCUIT BREAKER

CROSS-REFERENCE TO RELATED APPLICATION

This application claims the benefit of U.S. Provisional Application No. 60/615,124 entitled "Self Retaining Sliding Bar Interlock For Circuit Breaker," which was filed on Oct. 1, 2004.

BACKGROUND OF THE INVENTION

1. Field of the Invention

This invention relates to an interlock assembly for a pair of circuit breakers and, more specifically, to an interlock assembly having a self retaining sliding bar mechanism which allows an operator to use both hands to toggle the breaker.

2. Background Information

There are a number of applications where it is required that the operation of two circuit breakers be coordinated such that only one circuit breaker can be in the closed, operating position at one time. For example, the operation of two circuit breakers must be coordinated when providing a power-consuming load with electrical power from either of two different sources, such as a commercial power system and an auxiliary supply. It is imperative in such applications that only one circuit breaker be in the closed, operating position at one time. A device that prevents both circuit breakers from being in the operating position is called an interlock.

Circuit breaker interlocks are known which couple the actuating means, for example, operating handles, of circuit breakers whose operation is to be coordinated. One common type of interlock assembly, such as is described in, for example, U.S. Pat. No. 6,043,439, utilizes a sliding bar that moves between a position wherein a first circuit breaker handle is blocked and a second circuit breaker handle is free to move and a position wherein the first circuit breaker handle is free to move and the second circuit breaker handle is blocked.

In many industrial applications, circuit breakers are mounted in a vertical relationship with respect to one another wherein one circuit breaker is mounted and stacked above the other circuit breaker. In such a configuration, the actuating mechanism, such as an operating handle, of each circuit breaker travels in a horizontal direction (perpendicular to the vertical orientation of the circuit breakers) from a closed position on a first side of the circuit breaker to an open position on a second side of the circuit breaker that is opposite the first side. In circuit breaker pairs that are oriented in this manner that utilize a sliding bar interlock assembly, the sliding bar will slide in the vertical direction to selectively block either the actuating mechanism of the top circuit breaker or the actuating mechanism of the bottom circuit beaker.

Thus, if the top circuit breaker in such a pair is in a closed condition (actuating mechanism positioned on the first side), the bottom circuit breaker in the pair will be in an open condition (actuating mechanism positioned on the second side), and the sliding bar will block the movement of the actuating mechanism of the bottom circuit breaker, thereby preventing it from changing from an open condition to a closed condition. In addition, the actuating mechanism of the top circuit breaker, when so positioned on the first side, will block the sliding bar and prevent it from sliding upward.

The sliding bar will not be able to slide unless and until the actuating mechanism of the top circuit breaker is moved to the second side (open condition), which is out of the way of the path of the sliding bar. Thus, if an operator wants to toggle the circuit breakers so as to move the top circuit breaker to an open condition and the bottom circuit breaker to a closed condition, the operator must move the actuating mechanism of the top circuit breaker to the second side where it will be out of the way of the sliding bar, slide the sliding bar up and out of the way of the actuating means of the bottom circuit breaker, and move the actuating mechanism of the bottom circuit breaker to the first side where it blocks movement of the sliding bar. These steps are made difficult by the fact that gravity will force the sliding bar downward if not held in place by the operator. Thus, the operator must hold the sliding bar up with one hand and move the actuating mechanism of the bottom circuit breaker to the first side with the other hand. With larger circuit breakers that require higher forces to move the actuating mechanisms, this may be very difficult. Thus, there is a need for a sliding bar interlock assembly for a pair of circuit breakers that allows both hands of the operator to be free when moving the circuit breaker actuating mechanisms.

SUMMARY OF THE INVENTION

These needs, and others, are addressed by the present invention which provides an interlock mechanism for preventing a first circuit breaker having a first actuating mechanism and a second circuit breaker having a second actuating mechanism from simultaneously being in a closed condition. The interlock mechanism includes a frame, a sliding bar slideably mounted within the frame, and one or more retaining protrusions extending outwardly from one or more inner edges of the frame. The sliding bar is movable between a first position and a second position. In the first position the sliding bar blocks a path of movement of the first actuating mechanism and in the second position the sliding bar blocks a path of movement of the second actuating mechanism. The one or more retaining protrusions frictionally engage the sliding bar when the sliding bar is in the first position and hold it in place. The one or more retaining protrusions preferably frictionally engage the sliding bar with a frictional force sufficient to resist the force of gravity. The sliding bar may be generally T-shaped and include a handle portion, a first blocking portion connected to a first side of the handle portion, and a second blocking portion connected to a second side of the handle portion opposite the first side of the handle portion.

In one embodiment, the first and second circuit breakers are arranged in a vertical relationship with respect to one another in a vertical plane substantially parallel to the direction of the gravitation force such that said first circuit breaker is located above said second circuit breaker. In addition, the first actuating mechanism is moveable between a first open position and a first closed position and the second actuating mechanism is moveable between a second open position and a second closed position, wherein when the first actuating mechanism is in the first closed position the first actuating mechanism prevents the sliding bar from moving from the second position to the first position, and wherein when the second actuating mechanism is in the second closed position the second actuating mechanism prevents the sliding bar from moving from the first position to the second position. The first actuating mechanism and the second actuating mechanism may each comprise an operating handle.

In another embodiment, the one or more retaining protrusions are located adjacent to a top portion of the frame, and the interlock mechanism further includes one or more second retaining protrusions extending outwardly from the one or more inner edges of the frame, the one or more second retaining protrusions being located adjacent to a bottom portion of the frame. The one or more second retaining protrusions frictionally engage the sliding bar when the sliding bar is in the second position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
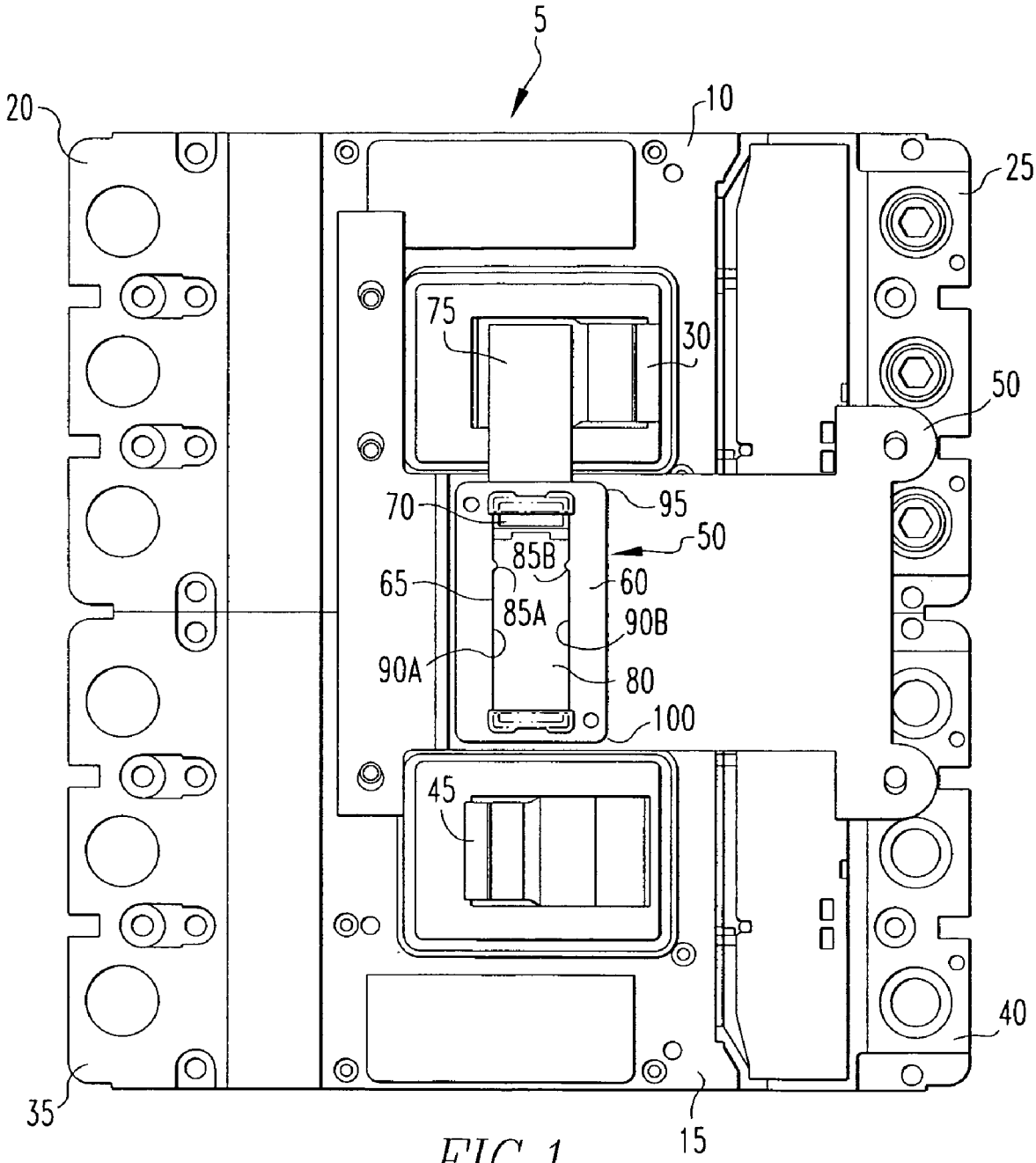
FIG. 1 is a front elevational view of a pair of circuit breakers having a an interlock assembly having a self retaining sliding bar mechanism according to the present invention.
Figure 2:
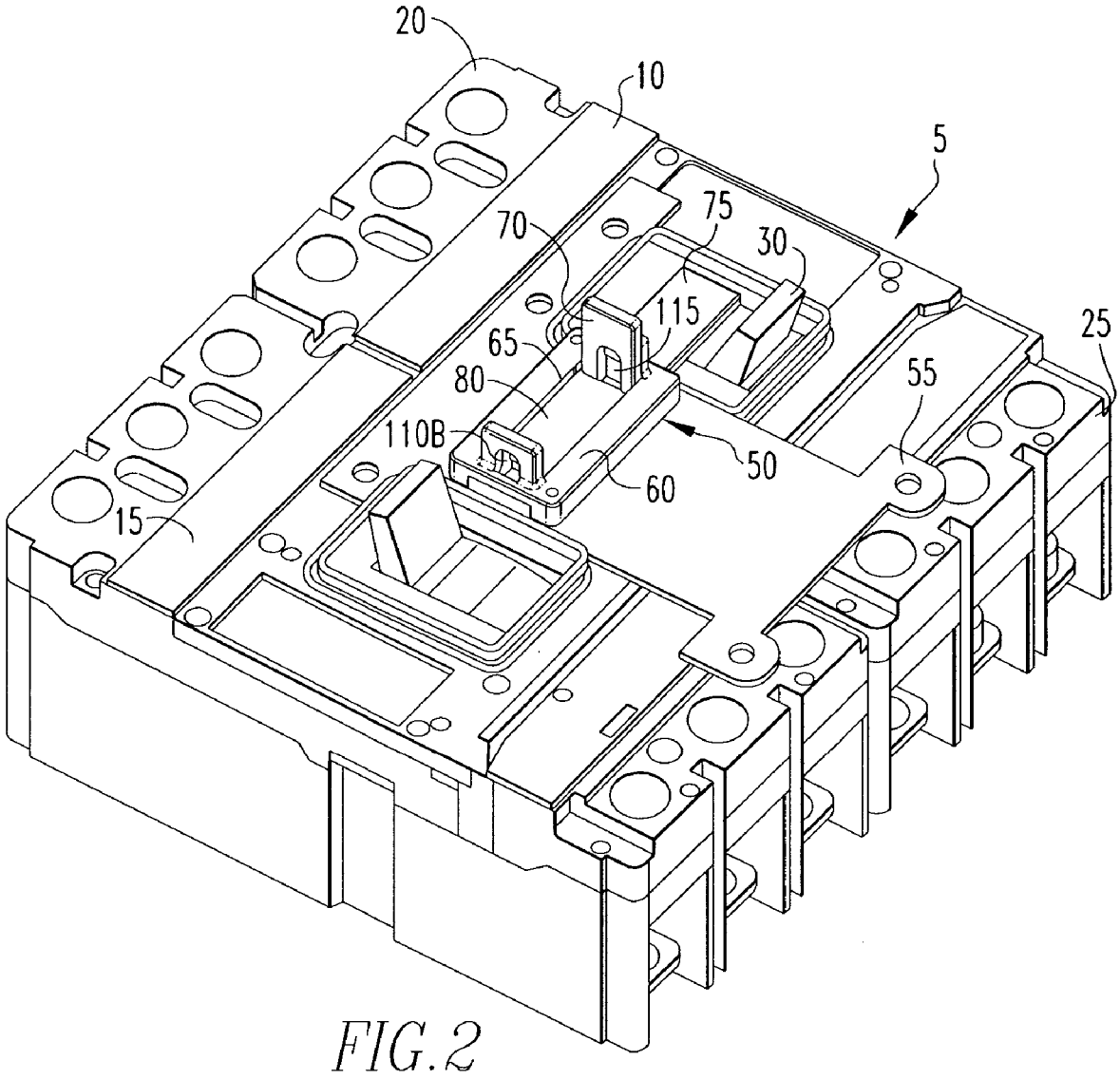
FIG. 2 is an isometric view of the pair of circuit breakers having a an interlock assembly having a self retaining sliding bar mechanism shown in FIG. 1.

FIG. 1 is a front elevational view and FIG. 2 is an isometric view of a circuit breaker assembly 5 according to the present invention. Circuit breaker assembly 5 includes circuit breaker 10 and circuit breaker 15. As seen in FIGS. 1 and 2, circuit breaker 10 and circuit breaker 15 are mounted in a vertical relationship with respect to one another wherein circuit breaker 10 is mounted and stacked above circuit breaker 15 such that the gravitational force applied to circuit breaker assembly 5 is as shown by the arrow in FIG. 1.

Circuit breaker 10 has a line side 20 having terminals for connecting to a power source and a load side 25 having terminals for connecting to a load. Circuit breaker 10 also has an operating handle 30 that is movable in an arcuate path in a horizontal direction that is generally perpendicular to the gravitational force shown by the arrow in FIG. 1. Operating handle 30 is movable from a closed position adjacent to line side 20 to an open position adjacent to load side 25. When operating handle 30 is in the closed position, circuit breaker 10 is in a closed, "on" condition, and when operating handle 30 is in the open position, circuit breaker 10 is in an open, "off" condition. Operating handle 30 is shown in FIGS. 1 and 2 in the open position.

Similarly, circuit breaker 15 has a line side 35 having terminals for connecting to a power source and a load side 40 having terminals for connecting to a load. Circuit breaker 15 also has an operating handle 45 that is movable in an arcuate path in a horizontal direction in the same manner as operating handle 30. Operating handle 45 is movable from a closed position adjacent to line side 35 to an open position adjacent to load side 40. When operating handle 45 is in the closed position, circuit breaker 15 is in a closed, "on" condition, and when operating handle 45 is in the open position, circuit breaker 15 is in an open, "off" condition. Operating handle 45 is shown in FIGS. 1 and 2 in the closed position.

Figure 3:
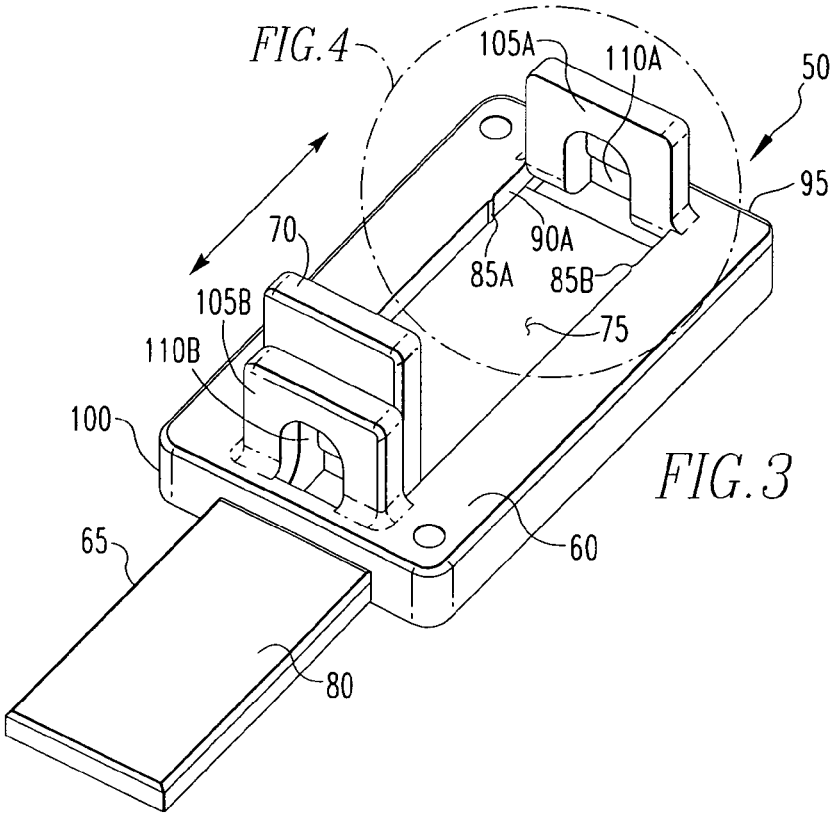
FIG. 3 is an isometric view of self retaining sliding bar mechanism according to the present invention.
Figure 4:
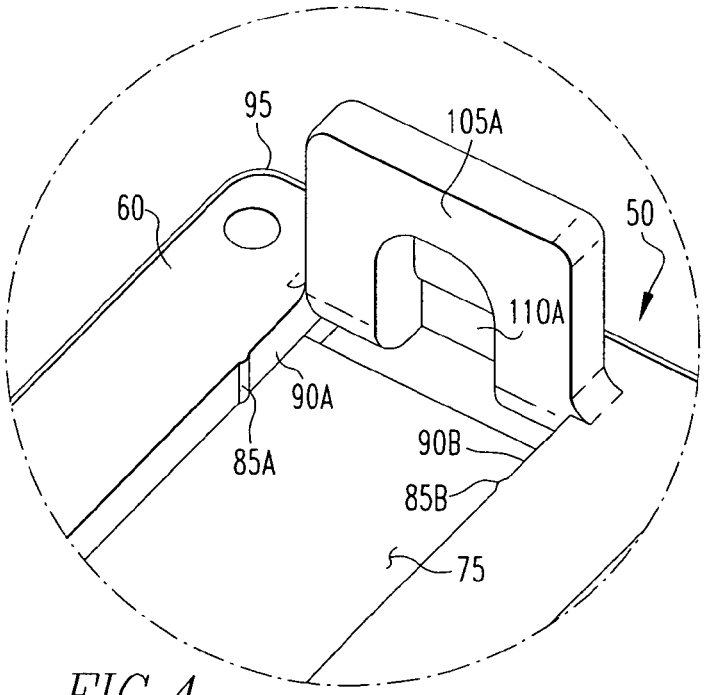
FIG. 4 is an enlarged view of a portion of the self retaining sliding bar mechanism shown in FIG. 3.

As seen in FIGS. 1 and 2, sliding bar interlock mechanism 50 is attached to mounting plate 55, which in turn is attached to circuit breaker assembly 5. FIG. 3 is an isometric view of sliding bar mechanism 50, and FIG. 4 is an enlarged view of the portion of sliding bar mechanism 50 enclosed in dotted lines in FIG. 3. Sliding bar mechanism 50 includes a generally rectangular frame 60. Sliding bar 65 is slideably mounted within frame 60 such that sliding bar 65 may slide within frame 60 in the direction of the arrows shown in FIG. 3. As seen in FIG. 3, sliding bar 65 generally has an inverted T-shape, and includes handle portion 70, first blocking portion 75 connected to one side of handle portion 70, and second blocking portion 80 connected to the opposite side of handle portion 70.

Thus, referring to FIGS. 1 and 2, sliding bar 65 may be selectively moved between a first position (shown in FIGS. 1 and 2) wherein operating handle 30 of circuit breaker 10 is blocked and unable to move and operating handle 45 of circuit breaker 15 is free to move and a second position (not shown in FIGS. 1 and 2) wherein operating handle 30 of circuit breaker 10 is free to move and operating handle 45 of circuit breaker 15 is blocked. In addition, sliding bar 65 cannot be moved between the first and second positions without first moving the unblocked operating handle 30, 45, whichever the case may be, to the open position, because when operating handles 30 and 45 are in the closed position, they block movement of the sliding bar 65 within frame 60. Thus, as will be appreciated, such a configuration only allows one of circuit breaker 10 and circuit breaker 15 to be in a closed, "on" condition at a single time.

In addition, as seen in FIGS. 3 and 4, retaining protrusions 85A and 85B extend outwardly from inner edges 90A and 90B, respectively, of frame 60 at a location near a top portion 95 of frame 60. Retaining protrusions 85A and 85B and first blocking portion 75 are sized such that retaining protrusions 85A and 85B will frictionally engage a respective side of first blocking portion 75 when the distal end of first blocking portion 75 extends past the location of retaining protrusions 85A and 85B as sliding bar 65 is slid within frame 60. In particular, an interference fit is provided between frame 60 and first blocking portion 75 such that there is enough of a frictional engagement between retaining protrusions 85A and 85B and sliding bar 65 to hold sliding bar 65 in place when it is slid upwardly as shown in FIGS. 1 and 2 to a position where it out of the path that operating handle 45 travels. As a result, when circuit breaker assembly is in a condition wherein circuit breaker 10 is in a closed, "on" condition (operating handle 30 is in the closed position adjacent to line side 20) and circuit breaker 15 is in an open, "off" condition (operating handle 45 is in the open position adjacent to load side 40) such that sliding bar 65 is blocking the path of operating handle 45, and an operator wants to toggle the circuit breakers 10 and 15 to the opposite conditions, the operator may move operating handle 30 of circuit breaker 10 to the open position adjacent to load side 25 where it will be out of the way of sliding bar 65, and slide sliding bar 65 up and out of the way of operating handle 45. Sliding bar 65 will be held in this position because of the frictional engagement between retaining protrusions 85A and 85B and sliding bar 65 as described above. The operator may then let go of sliding bar 65 and use both hands to move operating handle 45 of circuit breaker 15 to the closed position adjacent to line side 35 where it will block downward movement of sliding bar 65.

Retaining protrusions similar to retaining protrusions 85A and 85B may also be provided at a location near bottom portion 100 of frame 60 to frictionally engage a respective side of second blocking portion 80 when the distal end of second blocking portion 80 extends past the location of the retaining protrusions as sliding bar 65 is slid within frame 60. These additional retaining protrusions may be useful in situations where it is desired to invert circuit breaker assembly 5 such that circuit breaker 10 is on the bottom and circuit breaker 15 is on the top. In addition, in situations where circuit breaker assembly 5 is positioned such that circuit breaker 10 and circuit breaker 15 are placed next to one another in a horizontal fashion wherein operating handles 30, 45 and sliding bar 65 will move in a horizontal, rather than vertical direction, having retaining protrusions at both top portion 95 and bottom portion 100 of frame 60 will protect against the inadvertent movement of sliding bar 65, such as may be caused by a person brushing up against sliding bar 65. In addition, it is known that circuit breakers are often place in location and/or with enclosure that are subject to vibrations from various sources. Having retaining protrusions at either or both of top portion 95 and bottom portion 100 of frame 60 will protect against the movement of sliding bar 65 due to such vibrations.

Finally, referring to FIG. 3, frame 60 includes upwardly extending tabs 105A and 105B having apertures 110A and 110B therein. In addition, handle portion 70 of sliding bar 65 includes an aperture 115 therein (FIG. 2). Apertures 110A and 115 are together adapted to receive a padlock therethrough for locking sliding bar 65 in place when it is positioned in the path of actuating mechanism 30. Similarly, apertures 110B and 15 are together adapted to receive a padlock therethrough for locking sliding bar 65 in place when it is positioned in the path of actuating mechanism 45.

Thus, the present invention provides a sliding bar interlock mechanism for a circuit breaker assembly that counteracts the adverse effects that gravity and/or vibrations had on prior are sliding bar interlock mechanisms described herein and enables an operator to use both hands to move the actuating mechanisms of the circuit breaker assembly, such as larger circuit breakers that require higher forces to move the actuating mechanisms. The present invention provides a sliding bar interlock mechanism that protects against the inadvertent movement of the sliding bar.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An interlock mechanism for preventing a first circuit breaker having a first actuating mechanism and a second circuit breaker having a second actuating mechanism from simultaneously being in a closed condition, comprising:

a frame;

a sliding bar slideably mounted within said frame, said sliding bar being movable between a first position and a second position, said sliding bar in said first position blocking a path of movement of said first actuating mechanism and said sliding bar in said second position blocking a path of movement of said second actuating mechanism;

one or more retaining protrusions extending outwardly from one or more inner edges of said frame, said one or more retaining protrusions frictionally engaging said sliding bar when said sliding bar is in said first position; and wherein said first and second circuit breakers and said sliding bar are subject to a gravitational force acting in a first direction, said sliding bar being movable in a second direction generally parallel to said first direction, said one or more retaining protrusions frictionally engaging said sliding bar with a frictional force sufficient to resist said gravitational force, wherein said first and second circuit breakers are arranged in a vertical relationship with respect to one another in a vertical plane substantially parallel to said first direction such that said first circuit breaker is located above said second circuit breaker.

2. The interlock mechanism of claim 1, wherein when said sliding bar is in said first position, said sliding bar is outside of said path of movement of said second actuating mechanism and when said sliding bar is in said second position, said sliding bar is outside of said path of movement of said first actuating mechanism.

3. The interlock mechanism of claim 1, wherein said first actuating mechanism is moveable between a first open position and a first closed position along said path of movement of said first actuating mechanism, and said second actuating mechanism is moveable between a second open position and a second closed position along said path of movement of said second actuating mechanism.

4. The interlock mechanism of claim 3, wherein when said first actuating mechanism is in said first closed position said first actuating mechanism prevents said sliding bar from moving from said second position to said first position, and wherein when said second actuating mechanism is in said second closed position said second actuating mechanism prevents said sliding bar from moving from said first position to said second position.

5. The interlock mechanism of claim 1, wherein said first actuating mechanism and said second actuating mechanism each comprise an operating handle.

6. The interlock mechanism of claim 1, wherein said one or more retaining protrusions comprise a first retaining protrusion extending outwardly from a first inner edge of said frame and a second retaining protrusion extending outwardly from a second inner edge of said frame.

7. The interlock mechanism of claim 1, wherein said one or more retaining protrusions are located adjacent to a top portion of said frame, said interlock mechanism further including one or more second retaining protrusions extending outwardly from said one or more inner edges of said frame, said one or more second retaining protrusions being located adjacent to a bottom portion of said frame and frictionally engaging said sliding bar when said sliding bar is in said second position.

8. The interlock mechanism of claim 1, wherein said sliding bar is generally T-shaped and includes a handle portion, a first blocking portion connected to a first side of said handle portion, and a second blocking portion connected to a second side of said handle portion opposite said first side of said handle portion.

9. The interlock mechanism of claim 1, wherein said sliding bar has a first blocking portion and a second blocking portion, and when said sliding bar is in said first position, said first blocking portion blocks said path of movement of said first actuating mechanism and when said sliding bar is in said second position, said second blocking portion blocks said path of movement of said second actuating mechanism.

10. The interlock mechanism of claim 9, wherein when said sliding bar is in said first position, said second blocking portion is outside of said path of movement of said second actuating mechanism and when said sliding bar is in said second position, said first blocking portion is outside of said path of movement of said first actuating mechanism.

* * * * *